US011189963B2

(12) United States Patent
Kawashima et al.

(10) Patent No.: US 11,189,963 B2
(45) Date of Patent: Nov. 30, 2021

(54) CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Naomichi Kawashima, Mie (JP); Tomohiko Kobayashi, Mie (JP); Yutaro Yoshida, Mie (JP); Masatoshi Ito, Mie (JP); Hirokazu Komori, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/762,910

(22) PCT Filed: Nov. 6, 2018

(86) PCT No.: PCT/JP2018/041105
§ 371 (c)(1),
(2) Date: May 8, 2020

(87) PCT Pub. No.: WO2019/093298
PCT Pub. Date: May 16, 2019

(65) Prior Publication Data

US 2021/0175661 A1 Jun. 10, 2021

(30) Foreign Application Priority Data

Nov. 8, 2017 (JP) ..... JP2017-215640

(51) Int. Cl.
*H01R 13/533* (2006.01)
*H01R 13/506* (2006.01)

(52) U.S. Cl.
CPC ..... *H01R 13/533* (2013.01); *H01R 13/506* (2013.01)

(58) Field of Classification Search
CPC ... H01R 13/533; H01R 13/506; H01R 13/516
See application file for complete search history.

(56) References Cited

U.S. PATENT DOCUMENTS 5,154,630 A * 10/1992 Kamono ..... H01R 13/4361 439/352
7,168,981 B2 * 1/2007 Takahashi ..... H01R 13/4223 439/595

(Continued)

FOREIGN PATENT DOCUMENTS

JP 2003-210218 7/2003
JP 2009-93896 4/2009

(Continued)

OTHER PUBLICATIONS

International Search Report dated Jan. 29, 2019.

*Primary Examiner* — Briggitte R. Hammond
(74) *Attorney, Agent, or Firm* — Gerald E. Hespos; Michael J. Porco; Matthew T. Hespos

(57) ABSTRACT

A connector (female connector 1) is provided with an inner housing 20 from which wires W are pulled out to outside and which is connected to a mating housing 90, and a vibration transmitting member 30, 40 including a mating contact portion (inner peripheral surface 31A) capable of coming into contact with the mating housing 90. The vibration transmitting member 30, 40 includes a wire fixing portion 43 to which the wires W are fixed, and is capable of transmitting vibration from the wire fixing portion 43 to the mating housing 90 from the mating contact portion 31A. The inner housing 20 is allowed to relatively move with respect to the vibration transmitting member 30, 40.

5 Claims, 11 Drawing Sheets

(56) References Cited

U.S. PATENT DOCUMENTS

| | | | | |
|---|---|---|---|---|
| 7,381,072 | B2 * | 6/2008 | Nagano | H01R 13/506 439/248 |
| 10,090,613 | B2 * | 10/2018 | Choi | H01R 13/518 |
| 2002/0001987 | A1 | 1/2002 | Murakami et al. | |
| 2002/0009932 | A1 | 1/2002 | Inaba et al. | |
| 2011/0143566 | A1 | 6/2011 | Nakamura | |
| 2017/0222358 | A1 | 8/2017 | Hashimoto et al. | |

FOREIGN PATENT DOCUMENTS

| | | |
|---|---|---|
| JP | 2011-129296 | 6/2011 |
| JP | 2017-73301 | 4/2017 |
| JP | 2017-135068 | 8/2017 |

* cited by examiner

CONNECTOR

BACKGROUND

Field of the Invention

This specification relates to a connector.

Related Art

Japanese Unexamined Patent Publication No. 2009-93896 discloses a connector including a male housing and a female housing and used in a vehicle or the like. A first housing of this connector includes an inner housing with a cavity and an outer housing with a tubular fitting. The tubular fitting is connected to a second housing that has a mating terminal.

The outer housing is assembled with the inner housing by covering the inner housing from behind with the tubular fitting. A holding hole is provided in the rear end surface of the outer housing, and a female terminal fitting is inserted into the cavity of the inner housing through this holding hole. A wire is connected to the rear end of the female terminal fitting, and a rubber plug is fit externally on the outer periphery of the wire. A body of the rubber plug is held in close contact with the inner periphery of a rear end of the cavity in a liquid-tight manner, and an anti-vibration portion provided on the rear end of the rubber plug is fit into the holding hole.

A clearance exists between the outer peripheral surface of a rear end part of the inner housing and the inner peripheral surface of a rear surface wall of the tubular fitting of the outer housing for allowing a slight relative displacement of the outer housing with respect to the inner housing. If the wire drawn out rearwardly from the outer housing vibrates in a direction intersecting an axis thereof, part of vibration energy is absorbed as kinetic energy for displacing the outer housing. In this way, vibration transmitted from the wire to the female terminal fitting is attenuated and fretting wear on a contact point between the female terminal fitting and a mating terminal fitting is prevented.

However, in this configuration, if the vibration energy of the wire cannot be absorbed sufficiently even if a displacement is made in the clearance, the outer housing contacts the inner housing and the kinetic energy is transmitted to the inner housing. As a result, the inner housing vibrates and fretting wear occurs on the contact point between the female terminal fitting and the mating terminal fitting accommodated inside the inner housing.

SUMMARY

A connector disclosed in this specification includes an inner housing, a wire pulled out to outside from the inner housing, and a vibration transmitting member. The inner housing is configured to be connected to a mating housing. The vibration transmitting member includes a mating contact portion capable of coming into contact with the mating housing and further includes a wire fixing portion that is fixed to the wire. The wire fixing portion is capable of transmitting vibration from the wire fixing portion to the mating housing from the mating contact portion, and the inner housing is allowed to move with respect to the vibration transmitting member.

According to this configuration, if the wire vibrates, that vibration is transmitted from the wire fixing portion to the mating housing via the vibration transmitting member. Thus, vibration transmitted from the wire to the inner housing can be reduced. Even if the vibration is transmitted from the wire to the inner housing, the vibration transmitted from the wire can be attenuated since the inner housing is allowed to move with respect to the vibration transmitting member. In this way, the vibration attenuated by a relative movement of the inner housing can be suppressed by a contact pressure between terminals, for example, in the case of accommodating the terminals into the inner housing and the mating housing and bringing the terminals into contact with each other. Thus, wear due to sliding movements of the terminals can be suppressed.

The inner housing may include a lock piece, and a lock projection of the vibration transmitting member is lockable to the lock piece. A clearance is provided between the lock projection and the lock piece so that the inner housing can move with respect to the vibration transmitting member. According to this configuration, the lock piece of the inner housing can be locked to the lock projection of the vibration transmitting member without the inner housing being connected to the mating housing, and these components can be handled integrally. Further, the clearance between the lock projection and the lock piece enables the inner housing and the vibration transmitting member to be handled integrally while ensuring a relative movement of the inner housing.

The vibration transmitting member includes an outer housing and a cover. The outer housing has the mating contact portion and is configured to cover the inner housing. The cover has the wire fixing portion and is configured to cover the outer housing and the wire. According to this configuration, the cover covers and protects the inner housing, the outer housing and the wire from outside.

The outer housing faces the mating housing across a first clearance and faces the inner housing across a second clearance that is larger than the first clearance. According to this configuration, even if the outer housing comes into contact with the mating housing (i.e. moves a dimension of the first clearance), the outer housing does not contact the inner housing, and vibration from the wire is not transmitted directly from the outer housing to the inner housing since that moving distance is shorter than a dimension of the second clearance.

According to the connector disclosed in this specification, it is possible to prevent the fretting wear of the terminals due to the vibration of the wire.

DETAILED DESCRIPTION

Figure 1:
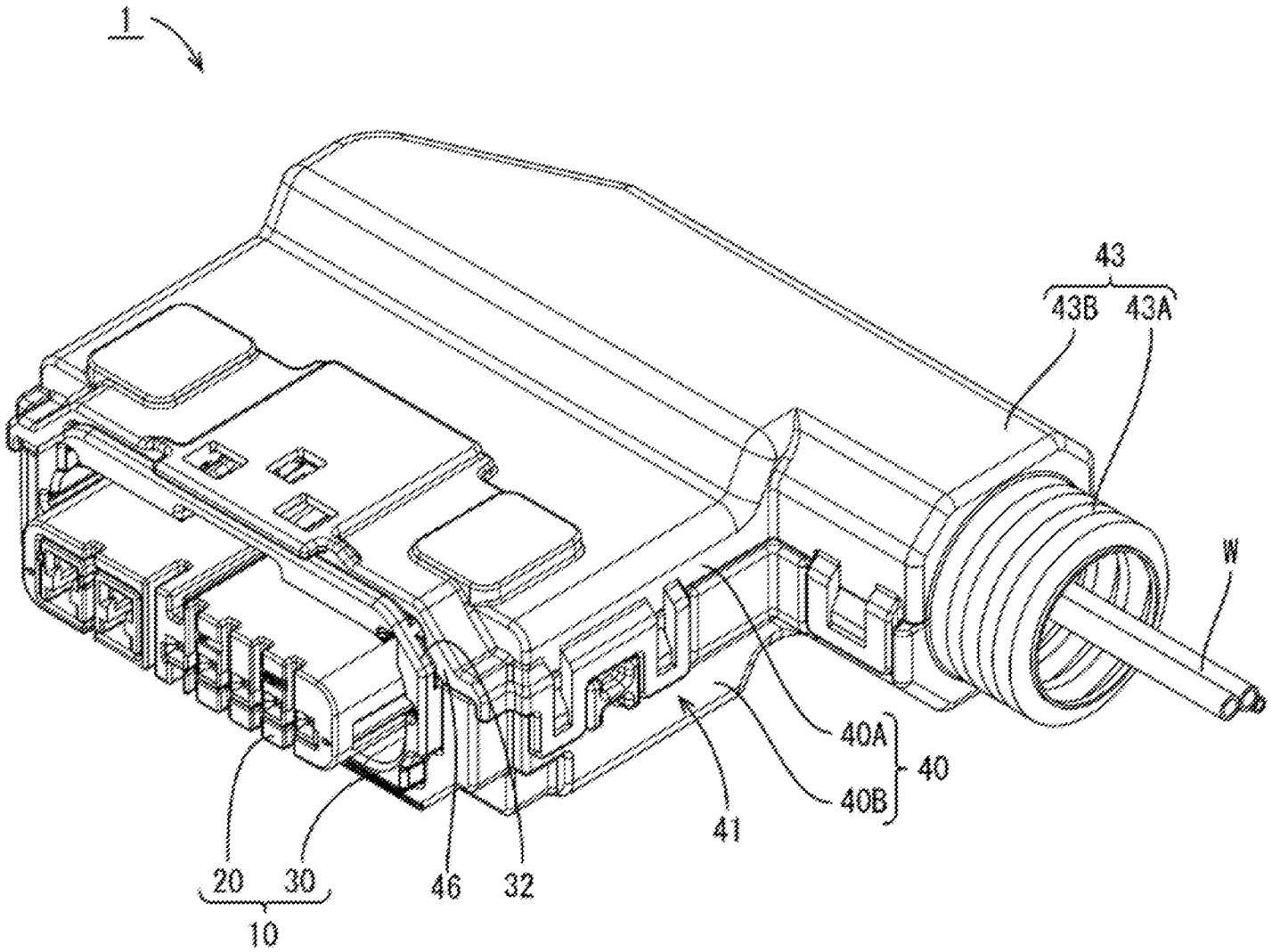
FIG. 1 is a perspective view showing a connector according to one embodiment.
Figure 2:
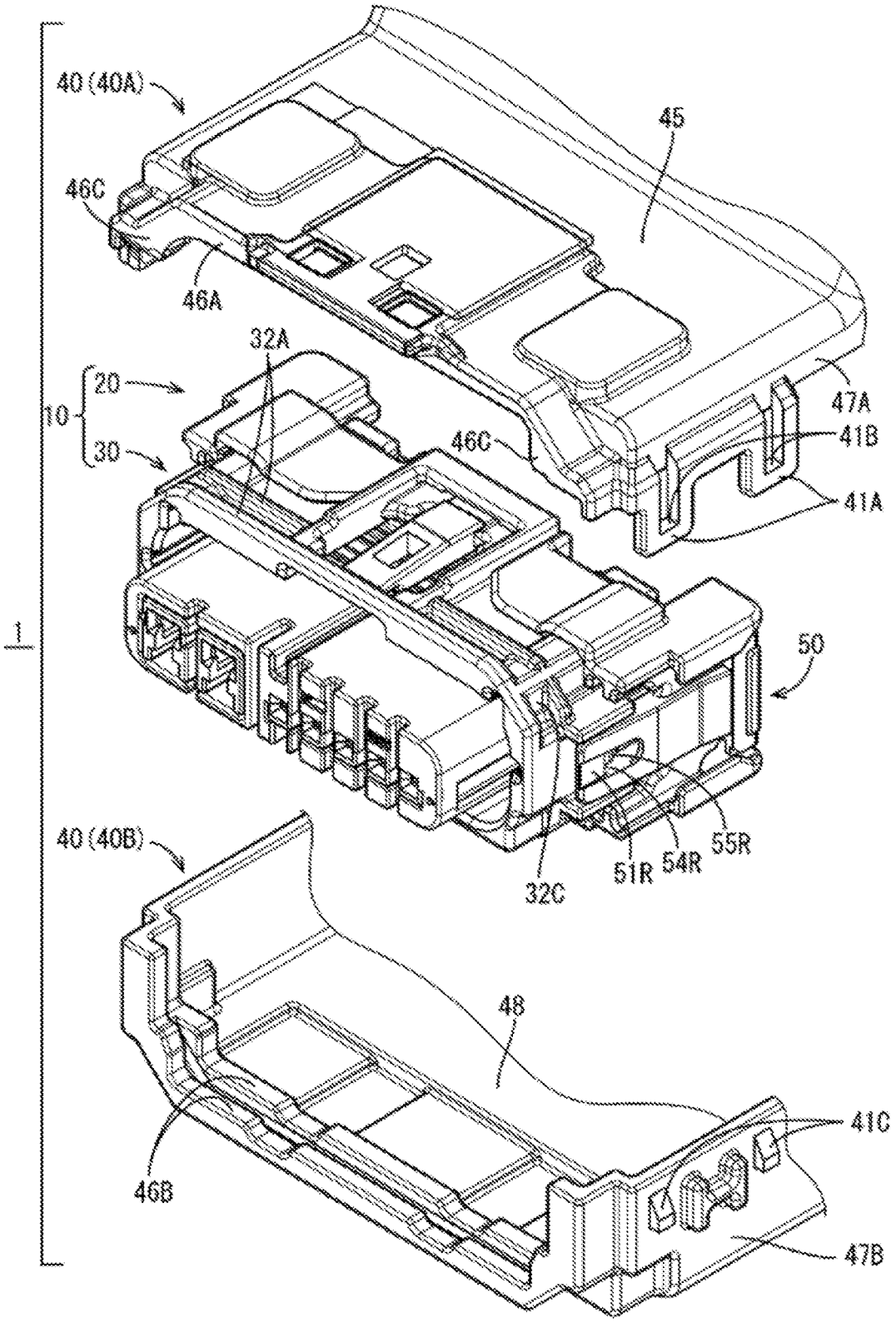
FIG. 2 is a perspective view showing a state where a cover member is removed.

One embodiment is described with reference to FIGS. 1 to 11. A female connector 1 (an example of a connector) of this embodiment is connected electrically to a mating connector by being fit to a mating housing 90 of the mating connector and is used in a vibrating environment in which vibration often occurs (e.g. around a tire of a vehicle). As shown in FIGS. 1 and 2, the female connector 1 includes a female housing 10 having a substantially rectangular parallelepiped shape somewhat flat as a whole and covers 40 for covering a female housing 10. Note that, in the following description, a connection side of the female housing 10 to the mating housing 90 is referred to as a front end and an upper side in FIG. 1 is referred to as an upper side.

Figure 3:
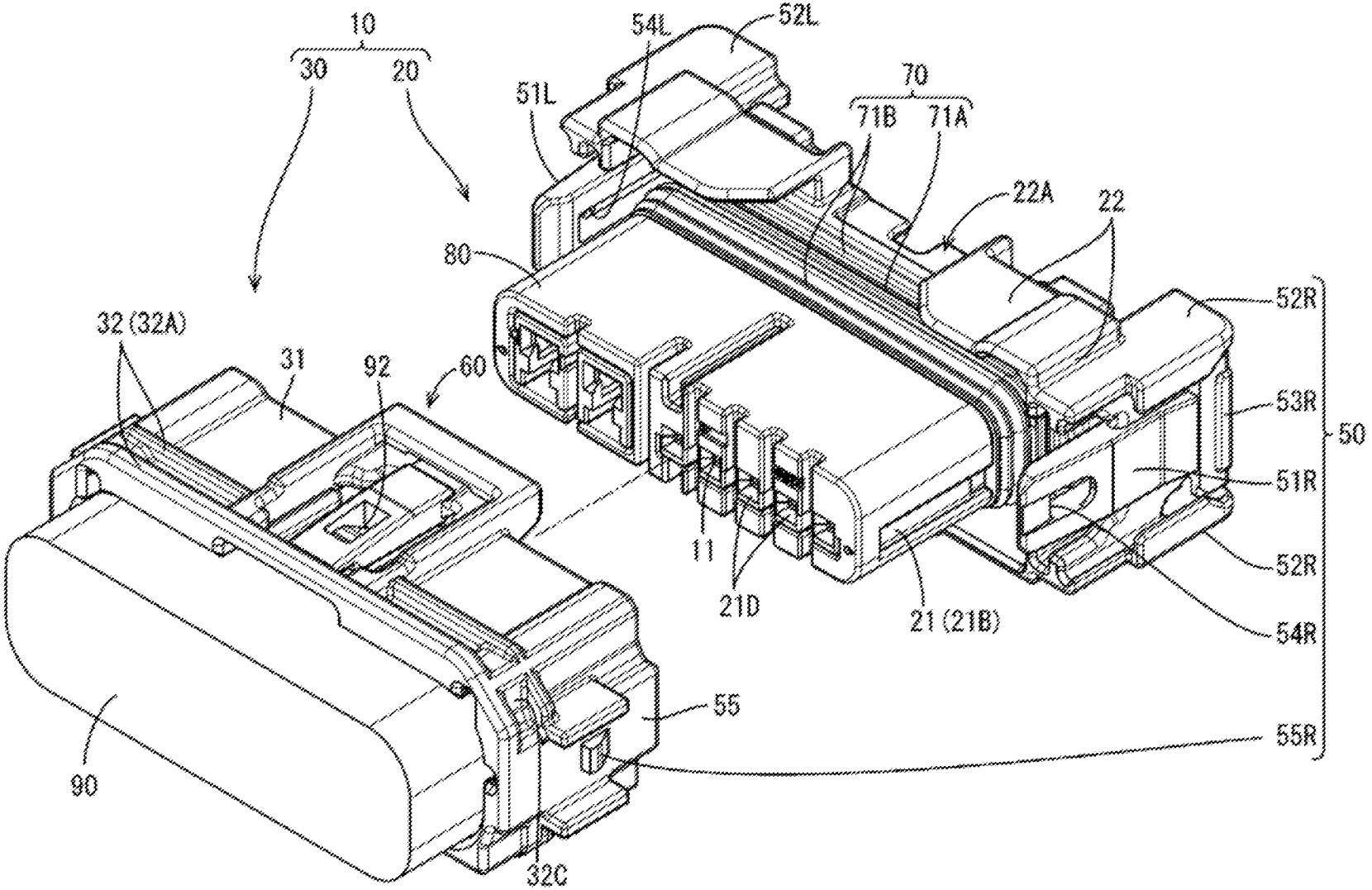
FIG. 3 is a perspective view showing a state where locking by first lock portions is released.

As shown in FIG. 3, the female housing 10 is composed of an inner housing 20 and an outer housing 30 disposed on an outer peripheral side of the inner housing 20. As shown in FIG. 2, the inner housing 20 and the outer housing 30 are assembled with each other by first locks 50 provided on the inner housing 20 and the outer housing 30.

Figure 4:
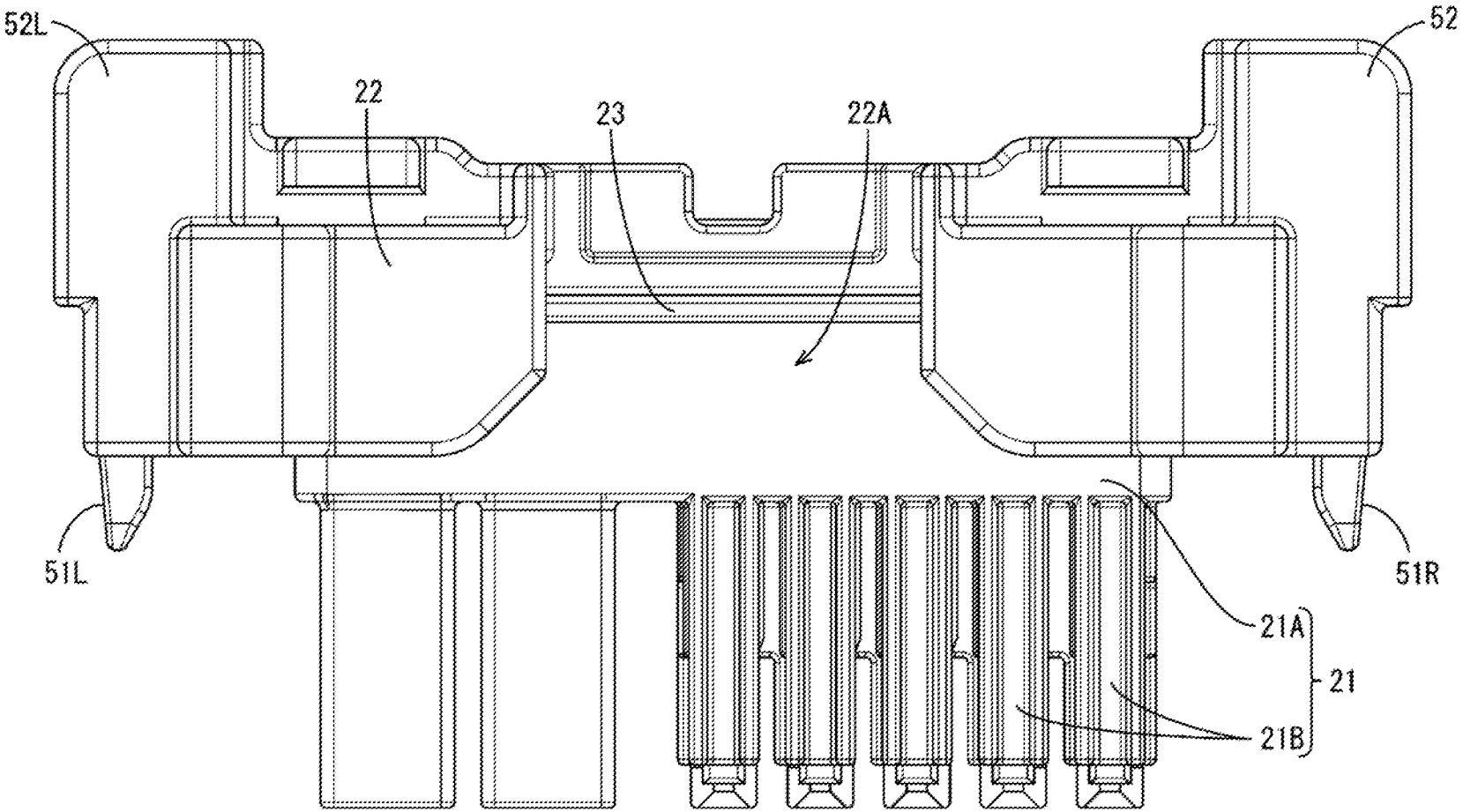
FIG. 4 is a plan view of an inner housing.
Figure 5:
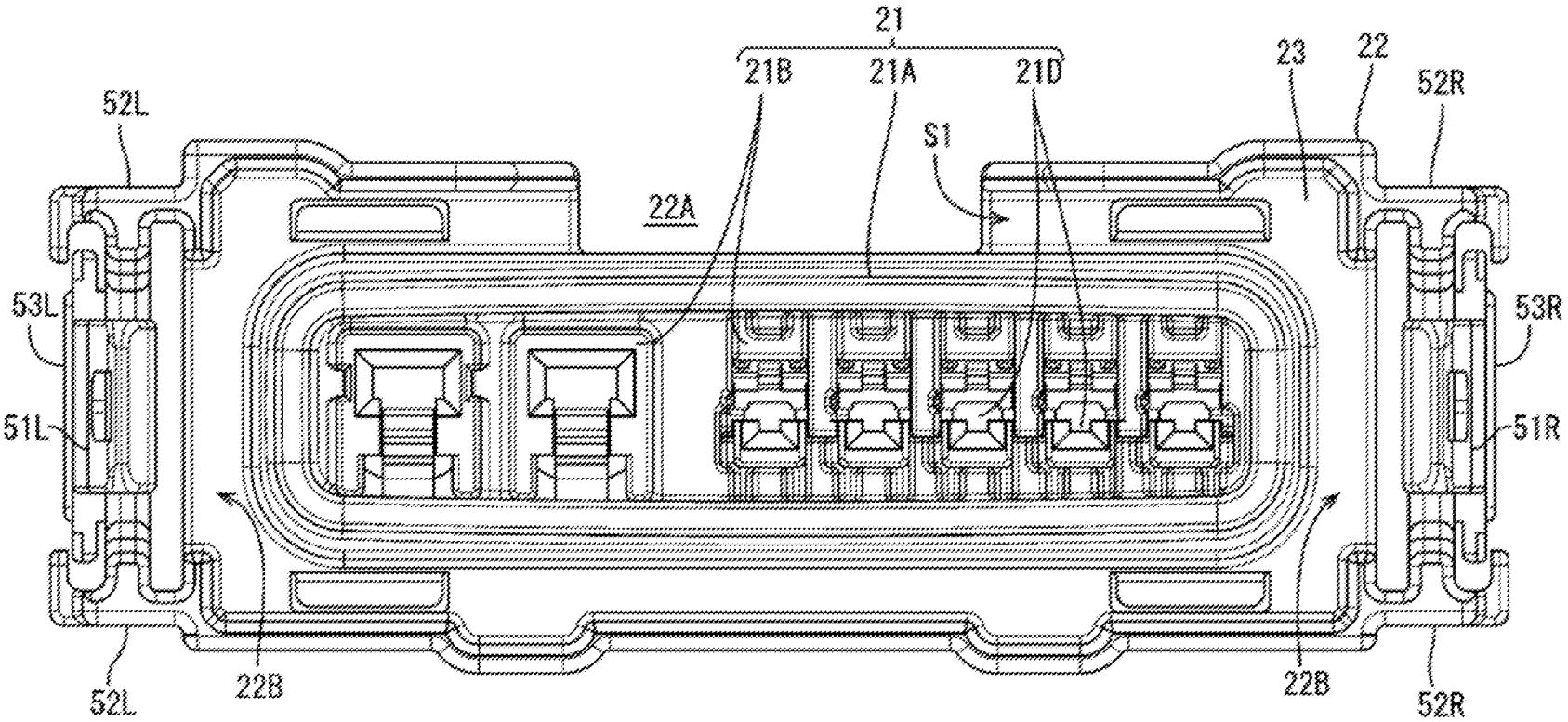
FIG. 5 is a front view showing the inner housing.

As shown in FIGS. 4 and 5, the inner housing 20 includes a rear wall 23, a terminal accommodating portion 21 and a rear receptacle 22. The terminal accommodating portion 21 is disposed in a central part of the rear wall 23 and has a wide flat shape. The rear receptacle 22 is disposed on an outer peripheral side of the terminal accommodating portion 21 and is to be fit to an outer periphery of the outer housing 30.

Figure 8:
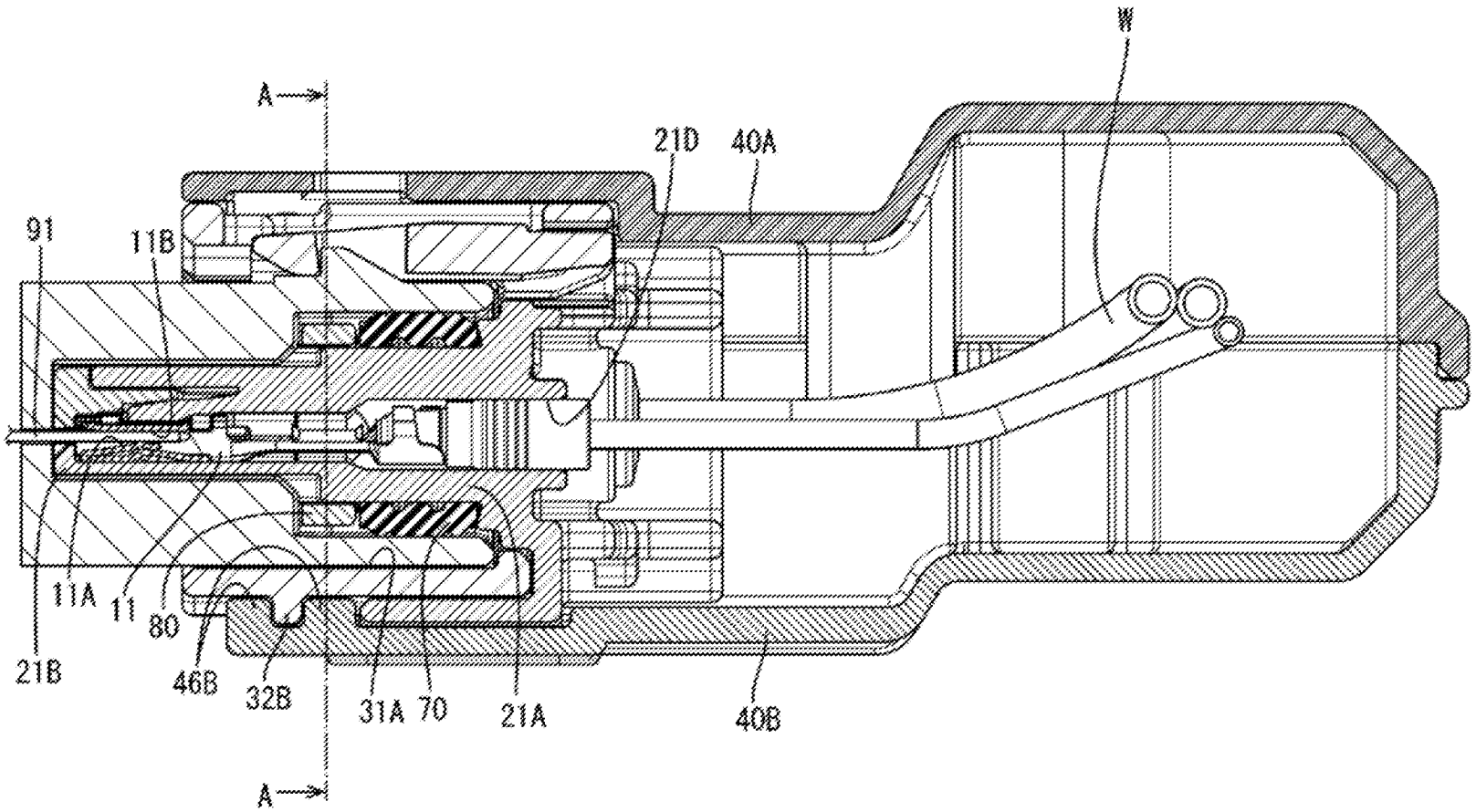
FIG. 8 is a section showing a state where a female housing and a mating housing are connected.
Figure 9:
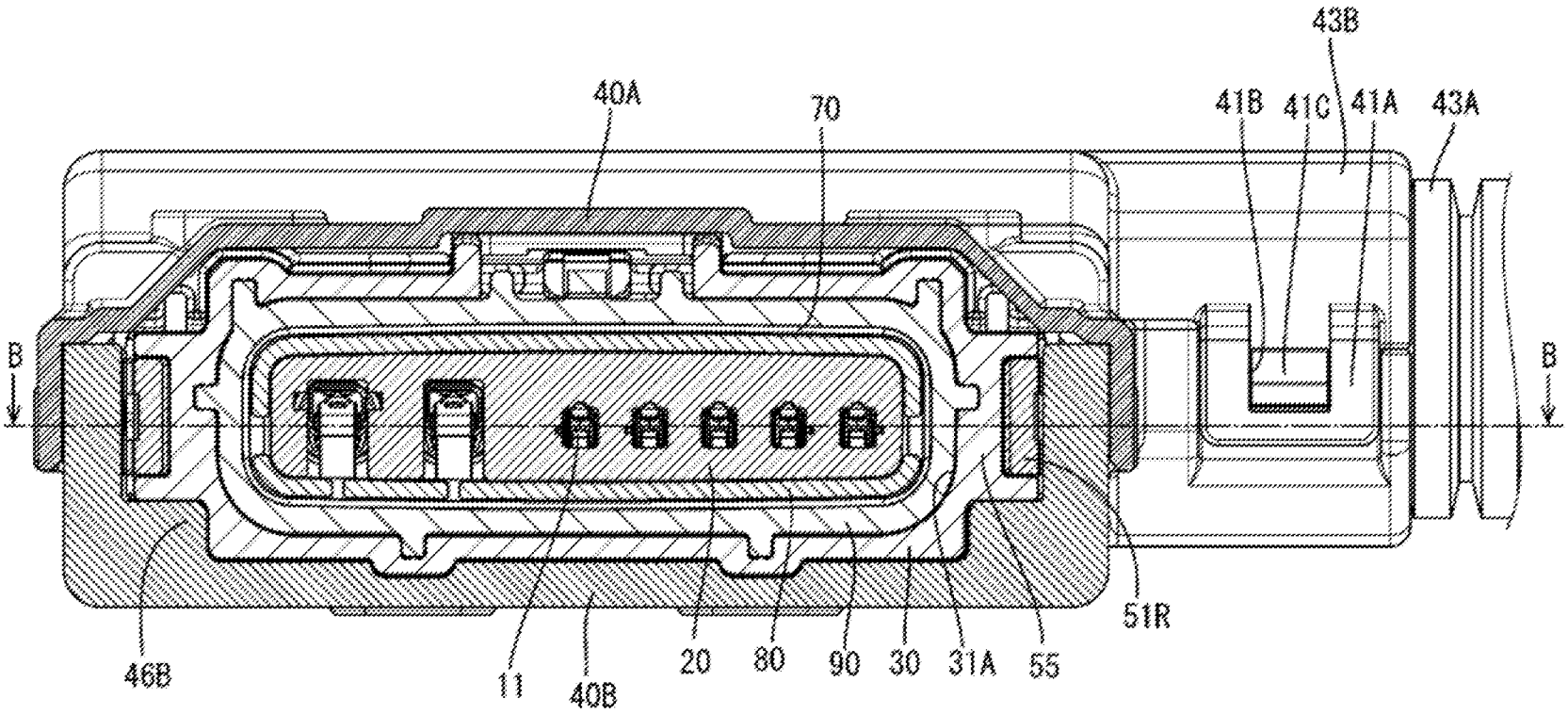
FIG. 9 is a section along A-A of FIG. 8.

The terminal accommodating portion 21 extends forward from the rear wall 23. A rear part of the terminal accommodating portion 21 defines a base 21A having a substantially rectangular parallelepiped shape, and a front part defines accommodating protrusions 21B that are long in a front-rear direction. As shown in FIG. 8, forwardly open cavities 21D penetrate in the front-rear direction from the front ends of the respective accommodating protrusions 21B to the rear end of the rear wall 23. A female terminal 11 is inserted into each cavity 21D through a rear opening. A wire W connected to the rear end of the female terminal 11 is pulled out to the outside of the inner housing 20 through the rear opening of the cavity 21D.

As shown in FIG. 8, the female terminal 11 includes a rectangular tube on a front side, and a cantilevered spring piece 11A is disposed to face an inner ceiling wall 11B of the rectangular tube inside the rectangular tube. In this way, the female terminal 11 is connected to the mating terminal 91 with a predetermined contact pressure by inserting a mating terminal 91 of the mating housing 90 into the rectangular tube.

As shown in FIG. 5, the rear receptacle 22 extends forward from a peripheral edge of the rear wall 23 and includes a second lock receiving groove 22A provided on an upper side of the terminal accommodating portion 21 and lock projection receiving grooves 22B provided on both left and right sides of the terminal accommodating portion 21. The second lock receiving groove 22A is formed by cutting an upper central part of the rear receptacle 22 and the rear wall 23 connected thereto in the front-rear direction. On the other hand, the lock projection receiving grooves 22B are formed by cutting both left and right sides of the rear receptacle 22 in the front-rear direction. Specifically, the rear receptacle 22 extends forward to surround the base 21A from a part of the upper edge excluding a central part, both upper and lower end parts of left and right side edges and the entire lower edge of the rear wall 23. A fitting space 51 is formed between the rear receptacle 22 and the base 21A, and can receive the outer housing 30 and the mating housing 90, as described later.

As shown in FIG. 3, a sealing ring 70 made of a resilient material is fit on the rear end of the base 21A. The sealing ring 70 has a rectangular frame shape with four rounded corners to correspond to the base 21A, and is in contact with the base 21A over the entire periphery in a liquid-tight manner. Lips 71, 71B are provided continuously in a circumferential direction on the outer peripheral surface of the sealing ring 70.

As shown in FIG. 3, the accommodating protrusions 21B are collectively covered with a front cap 80 having a wide flat rectangular tube shape. A closing wall is provided on a front of the front cap 80, and mating terminal insertion holes penetrate the closing wall in the front-rear direction. As shown in FIG. 8, the front cap 80 is arranged such that an inner peripheral surface near a rear end is in contact with the outer peripheral surface of the base 21A and a rear end faces the front end of the sealing ring 70.

As shown in FIGS. 3 and 5, a right lock piece 51R and upper and lower right supports 52R constituting the first lock 50 are provided on a right side of the terminal accommodating portion 21, and a left lock piece 51L and upper and lower lefts 52L constituting the first lock 50 are provided on a left side of the terminal accommodating portion 21. The right lock piece 51R and the right supports 52R, and the left lock piece 51L and the left supports 52L are provided at bilaterally symmetrical positions with the terminal accommodating portion 21 as a center, and the configurations thereof are bilaterally symmetrical with respect to the terminal accommodating portion 21. Accordingly, only the right lock piece 51R and the right supports 52R are described as representatives below, and the left lock piece 51L and the left supports 52L are not described and are shown with a suffix R of reference signs for the right lock piece 51L and the right supports 52L replaced by L. Further, in the following description, the right and left lock pieces 51L, 51R may collectively be called first lock pieces 51R, 51L.

As shown in FIGS. 4 and 5, the upper and lower right supports 52R bulge laterally from the rear receptacle 22 and connect to upper and lower side walls of the lock projection receiving groove 22B. The right lock piece 51R is a flat strip-like small piece disposed between the right supports 52R, and extends parallel to a side wall of the terminal accommodating portion 21. The right lock piece 51R is cantilevered while being supported on the upper right support 52R at a position rearward of a center of the upper edge thereof and is supported on the lower right support 52R at a position rearward of a center of the lower edge thereof, and the front and rear ends thereof are laterally movable. The rear end of the right lock piece 51R projects somewhat rightward, and serves as a right releasing portion 53R used by a worker to release the right lock piece 51R. A laterally penetrating right holding hole 54R is provided on a front part of the right lock piece 51R.

As shown in FIG. 3, the outer housing 30 includes a front receptacle 31 having a substantially rectangular tube shape and arranged on an outer periphery of the terminal accommodating portion 21 of the inner housing 20, pedestals 55 formed by parts of outer side surfaces of the front receptacle 31 projecting laterally outward, a right lock projection 55R and a left lock projection 55L constituting the first locks 50, a coupling receiving portion 32 and a second lock 60.

The right lock projection 55R projects rightward from the pedestal 55 and is provided at such a position as to be lockable to the right lock piece 51R by being fit into the right holding hole 54R of the inner housing 20 when the outer housing 30 is mounted on the outer periphery of the inner housing 20. The left lock projection 55L projects leftward from the pedestal 55 of the outer housing 30 and is provided at a position bilaterally symmetrical with the right lock projection 55R with the front receptacle 31 as a center.

Figure 10:
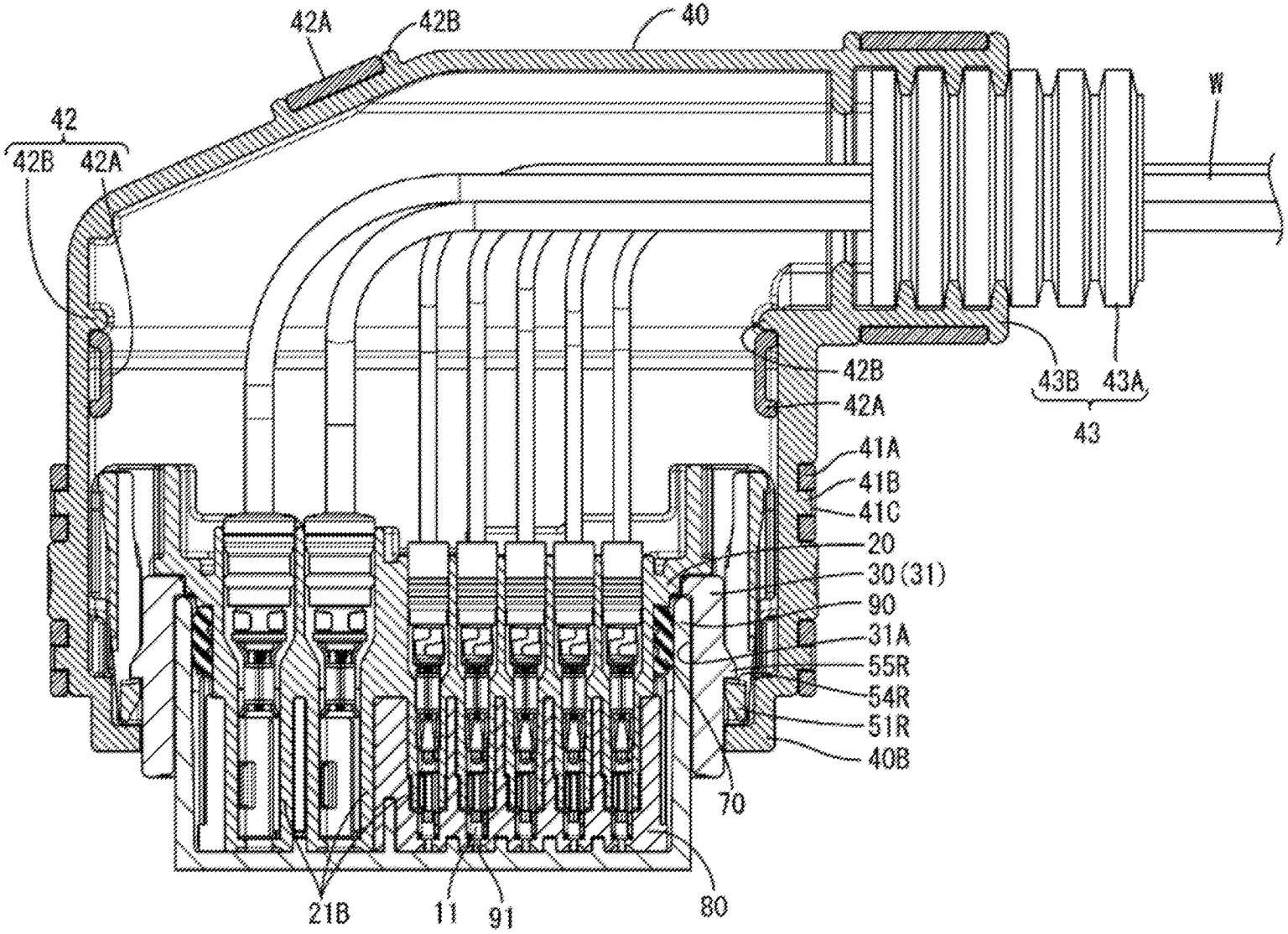
FIG. 10 is a section along B-B of FIG. 9.

With the outer housing 30 mounted on the outer periphery of the inner housing 20, the first lock 50 is locked by fitting the right lock projection 55R into the right holding hole 54R of the right lock piece 51R, as shown in FIGS. 2 and 10.

Figure 6:
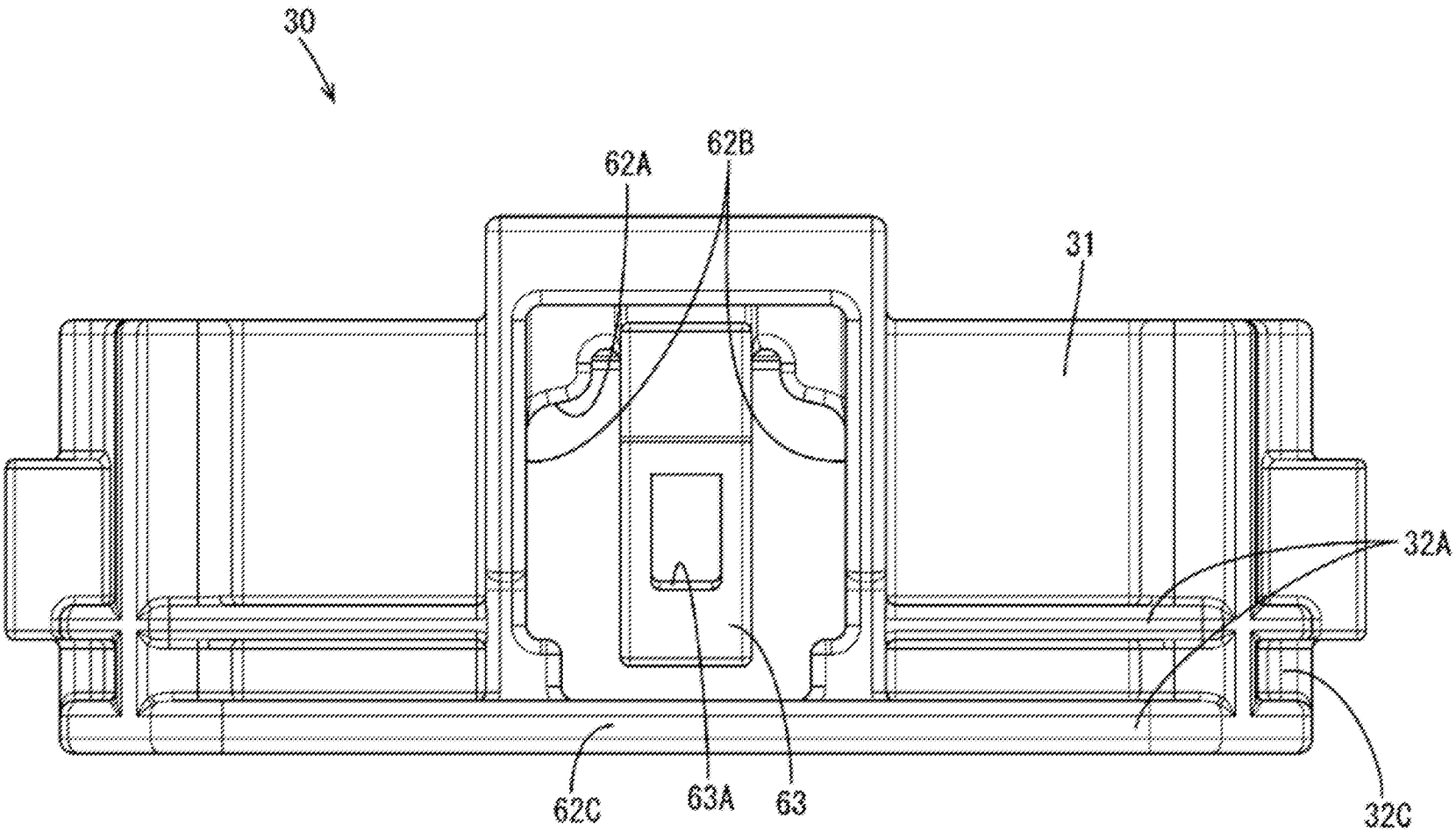
FIG. 6 is a plan view showing an outer housing.
Figure 7:
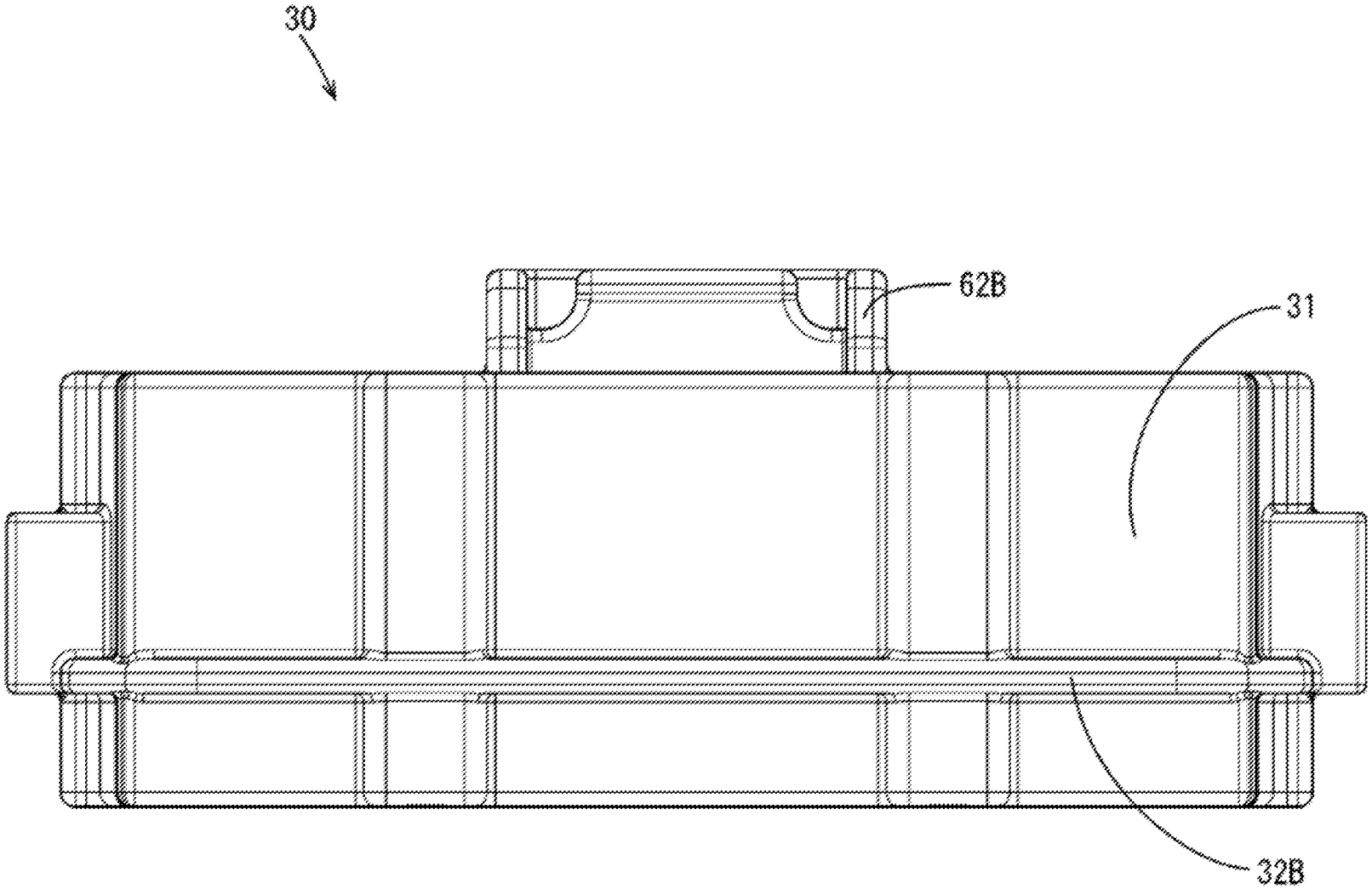
FIG. 7 is a bottom view showing the outer housing.

The coupling receiving portion 32 couples the cover 40 to the outer housing 30. As shown in FIGS. 3, 6 and 7, the coupling receiving portion 32 is composed of front and rear upper surface ridges 32A, a lower surface ridge 32B and a butting receiving portion 32C.

The upper surface ridges 32A project up from the front end of the upper surface of the front receptacle 31 and extend in the lateral direction. The lower surface ridge 32B projects down from the vicinity of the front end of the lower surface of the front receptacle 31 and extends in the lateral direction. As shown in FIG. 3, the butting receiving portion 32C is a recess having a substantially right triangular shape in a front view and is surrounded by an outer side surface of the front receptacle 31, the upper end of the pedestal 55 and right end parts of the front and rear upper surface ridge portions 32A.

The second lock 60 is provided on an upper surface side of the front receptacle 31 and, as shown in FIG. 6, is composed of an accommodation recess 62A, two accommodating walls 62B, a hand-touch restricting portion 62C and an upper lock piece 63.

The accommodation recess 62A vertically penetrates through the front receptacle 31 and is open forward. The accommodating walls 62B have a U-shape in a plan view to surround both sides and the rear end of the accommodation recess 62A, and constitute an inner wall of the accommodation recess 62A. The hand-touch restricting portion 62C extends to close a front end opening between the accommodating walls 62B and is U-shaped in a front view, as shown in FIG. 3.

The upper lock piece 63 is in the form of a cantilever extending toward a front end with the rear end of the accommodation recess 62A as a base. A through hole 63A vertically penetrates through a substantially central part of the upper surface side lock piece 63.

As shown in FIGS. 1 and 2, the cover 40 is composed of an upper cover 40A, a lower cover 40B and a wire tube 43A, and is a hollow body shaped such that the rear end of a somewhat flat rectangular tube extends toward one lateral side by assembling the upper cover 40A, the lower cover 40B and the wire tube 43A. Note that, in the following description, an opening on a rear is referred to as a rear opening 43B.

The cover 40 includes anti-slip portions 42 and cover locks 41, as shown in FIG. 10 and a coupling portion 46 to be coupled to the outer housing 30 and a wire fixing portion 43, as shown in FIG. 1.

As shown in FIG. 2, the anti-slip portion 42 is composed of an anti-slip piece 42A provided to extend down from outer and inner surface of a side wall 47A of the upper cover 40A and an anti-slip ridge 42B projecting laterally inward and outward from outer and inner surface sides of a side wall 47B of the lower cover 40B and extending in a vertical direction. Horizontal displacements of the upper and lower covers 40A, 40B are restricted by the contact of the anti-slip pieces 42A and the anti-slip ridges 42B.

As shown in FIG. 2, the cover lock 41 is composed of cover lock pieces 41A that extend down from the outer surface of the side wall 47A of the upper cover 40A and cover lock projections 41C projecting laterally out from the outer side of the side wall 47B of the lower cover 40B. A cover lock hole 41B laterally penetrates a lower part of each cover lock piece 41A. The upper and lower covers 40A, 40B are assembled with each other by fitting the cover lock projections 41C into the cover lock holes 41B.

As shown in FIG. 2, the coupling 46 is composed of an upper front frame portion 46A provided on the upper cover 40A, butting portions 46C provided on the upper cover 40A and two lower front frame portions 46B provided on the lower cover 40B. The upper front frame portion 46A projects down from the front end of the ceiling wall 45 of the upper cover 40A and extends in the lateral direction. The butting portions 46C project down from both left and right ends of the upper front frame portion 46A and have a right triangular shape in a front view. The lower front frame portions 46B are separated from each other in the front-rear direction, project up from the front end of the bottom wall portion 48 of the lower cover 40B and extend in the lateral direction.

With the cover 40 mounted on the female housing 10, the coupling 46 (i.e. upper front frame portion 46A, butting portions 46C and lower front frame portions 46B) is fit to the coupling receiving portion 32 (i.e. upper ridges 32A, butting receiving portions 32C and lower surface ridge 32) of the outer housing 30, as shown in FIG. 1. In this way, the cover 40 and the outer housing 30 are coupled to each other.

Note that a clearance may be provided between the cover 40 and the outer housing 30, considering a dimensional tolerance of each member, but any such clearance should not permit the inner housing 20 to contact the cover 40 even if the inner housing 20 moves with respect to the cover 40.

Figure 11:
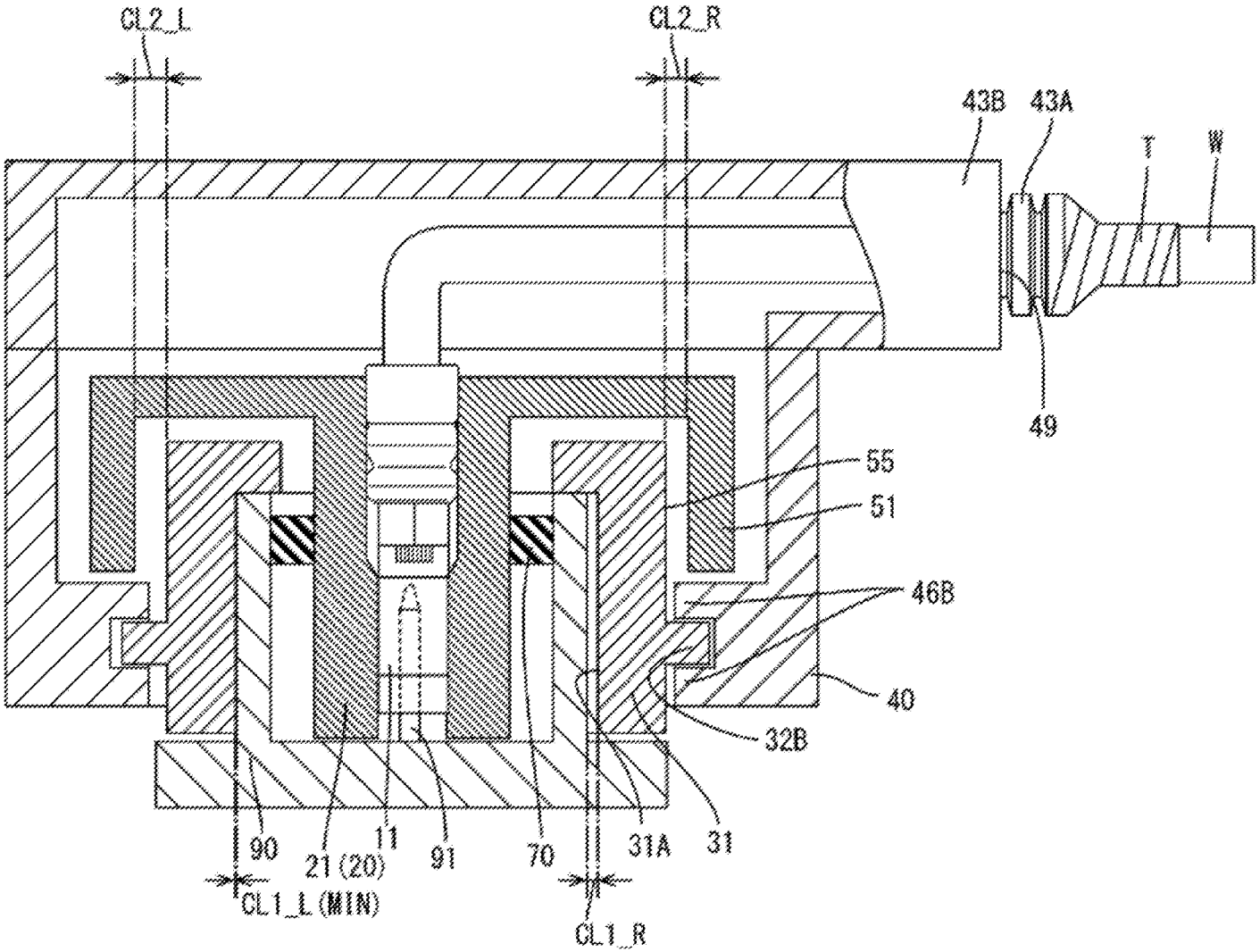
FIG. 11 is a conceptual diagram showing a connected state of the connector and the mating housing.

As shown in FIG. 10, the wire fixing portion 43 is composed of the rear opening 43B and the wire tube 43A fit into the rear opening 43B. The inner peripheral surface of the rear opening 43B and the outer peripheral surface of the wire tube 43A are formed into wavy shapes corresponding to each other. In this way, the wire tube 43A is fit tightly in the rear opening 43B with a relative movement with respect to the rear opening 43B and detachment from the rear opening 43B prevented. The wires W pulled out from the rear surface of the female housing 10 are pulled out to outside from the tip of the wire tube 43A through an internal space formed by the upper and lower covers 40A, 40B. Further, as shown in FIG. 11, a tape T is wound from the wire tube 43A to the wires W so that the wires W are fixed to the wire tube 43A.

The female connector 1 of this embodiment if formed by inserting the female terminals 11 into the cavities 21D of the inner housing 20 from behind with the wires W connected to the rear ends of the female terminals 11. The outer housing 30 then is mounted on the terminal accommodating portion 21 of the inner housing 20 from the front, and the first locks 50 are locked. Further, the wires W pulled out from the rear surface of the inner housing 20 are inserted into the wire tube 43A. The female housing 1 then is covered with the upper and lower covers 40A, 40B from above and below, and the cover locks 41 are locked while the wire tube 43A is fit into the rear opening 43B. The tape T then is wound from the wire tube 43A to the wires W. In this way, the outer housing 30 is coupled to the cover 40 and the wires W are fixed to the cover 40, thereby forming the female connector 1 in which the inner and outer housings 20, 30 are locked displaceably.

This female connector 1 is connected to the mating housing 90 by inserting the mating housing 90 between the terminal accommodating portion 21 and the outer housing 30 and moving the mating housing back in the fitting space Si of the inner housing 20. The mating housing 90 is inserted to a position where the rear end thereof faces the rear wall 23 with a predetermined clearance defined therebetween while the outer peripheral surface thereof faces or slides in contact with an inner peripheral surface 31A of the outer housing 30 (front receptacle 31) and the inner peripheral surface thereof slides in contact with the three lips 71A, 71B of the sealing ring 70. Along with this, the mating terminals 91 are inserted into the rectangular tubes of the female terminals 11 and are connected conductively to the female terminals 11 while being sandwiched with a predetermined contact pressure between the ceiling inner walls 11B of the rectangular tubes and the spring pieces 11A.

In this way, with the female connector 1 connected to the mating housing 90, the inner housing 20 is held in close contact with the inner periphery of the mating housing 90 over the entire periphery via the sealing ring 70 and integrally held due to the contact pressure between the female terminals 11 and the mating terminals 91 in the terminal accommodating portion 21.

In this state, clearances CL2 are set between the first lock pieces 51R, 51L of the inner housing 20 and the first lock projections 55R, 55L of the outer housing 30 in the first locks 50. In this way, the inner housing 20 is allowed to move with respect to the outer housing 30.

On the other hand, the inner peripheral surface 31A (an example of a mating contact portion) of the outer housing 30 (front receptacle 31) is facing the outer peripheral side of the mating housing 90 across a clearance CL1 due to dimensional tolerances and can come into contact with the outer peripheral side of the mating housing 90.

The cover 40 is coupled to the outer housing 30, as described above, covers the inner housing 20 while being sufficiently spaced apart therefrom, and is fixed to the wires W.

The wire W may move due to vibration or the like in this state. As a result, the cover 40 fixed to the wire W may contact the outer housing 30 together with the wire W. In this situation, the outer housing 30 moves and comes into contact with the mating housing 90 by being pushed by the cover member 40 so that any further movement is restricted. Also in this state, vibration from the wire W is allowed to escape to the mating housing 90 via the cover 40 and the outer housing 30 without being directly transmitted to the inner housing 20 since the inner housing 20 is relatively movable with respect to the outer housing 30 as described above. Specifically, the cover 40 and the outer housing 30 constitute a vibration transmitting member for transmitting the vibration of the wire W to the mating housing 90.

If a clearance between the outer housing 30 and the mating housing 90 is the first clearance CL1 and a clearance between the inner housing 20 and the outer housing 30 is the second clearance CL2 as described above, the first and second clearances CL1, CL2 are dimensioned to constantly satisfy CL1<CL2 (=Formula 1) in this embodiment.

More particularly, it is assumed that a clearance between the inner peripheral surface 31A of the outer housing 30 and the mating housing 90 and a clearance between the inner housing 20 and the outer housing 30 on a side leftward of the female terminals 11 and the mating terminals 91 are a left first clearance CL1_L and a left second clearance CL2_L, and a clearance between the inner peripheral surface 31A of the outer housing 30 and the mating housing 90 and a clearance between the inner housing 20 and the outer housing 30 on a side rightward of the female terminals 11 and the mating terminals 91 are a right first clearance CL1_R and a right second clearance CL2_R, for example, as shown in FIG. 11. It is further assumed that the outer housing 30 moved rightward to contact the mating housing 90 (i.e. a value of the left first clearance CL1_L became zero).

At this time, the inner housing 20 and the mating housing 90 are integrally fixed, the right first clearance CL1_R is maximized and the right second clearance CL2_R is minimized. However, since CL1_R<CL2_R (=Formula 1') is satisfied between CL1_R and CL2_R by the above Formula, the right second clearance CL2_R does not become zero. Specifically, even if the outer housing 30 contacts the mating housing 90, the inner housing 20 is kept relatively movable with respect to the outer housing 30 on an opposite side across the female terminals 11 and the mating terminals 91.

In this way, even if the cover member 40 moves in a direction perpendicular to an axial direction of the female terminals 11 by receiving the vibration of the wire W and comes into contact with the outer housing 30 to give an impact, the impact due to contact is allowed to escape to the mating housing 90 via the outer housing 30 while the inner housing 20 is caused to float with respect to the outer housing 30 in an internal space of the cover 40.

Note that, although not shown, the inner housing 20 and the outer housing 30 similarly are dimensioned to satisfy the first clearance CL1<the second clearance CL2 in each part also in the axial direction of the female terminals 11.

By the above configuration, the connector (female connector 1) according to this embodiment includes the inner housing 20 having the wires W pulled out to outside therefrom and to be connected to the mating housing 90. The connector also has the vibration transmitting member 30, 40 including the mating contact portion (inner peripheral surface 31A) capable of coming into contact with the mating housing 90. The vibration transmitting member 30, 40 includes the wire fixing portion 43, to which the wires W are fixed. Thus, vibration from the wire fixing portion 43 can be transmitted from the mating contact portion 31A to the mating housing 90, and the inner housing 20 is allowed to move with respect to the vibration transmitting member 30, 40. According to this configuration, if the wire W vibrates, that vibration is absorbed by the mating housing 90 via the vibration transmitting member 30, 40 from the wire fixing portion 43. Thus, vibration transmitted to the inner housing 20 from the wire W can be reduced. Even if vibration is transmitted from the wire W to the inner housing 20, the vibration transmitted from the wire W can be attenuated since the inner housing 20 is allowed to move with respect to the vibration transmitting member 30, 40. In this way, the vibration attenuated by a relative movement of the inner housing 20 can be suppressed by a contact pressure between the terminals 11, 91, for example, in the case of accommodating the terminals 11, 91 respectively into the inner housing 20 and the mating housing 90 and bringing the terminals 11, 91 into contact with each other. Thus, wear caused by sliding movements of the terminals 11, 91 can be suppressed.

Further, the inner housing 20 includes the lock pieces 51R, 51L, to which the lock projections 55R, 55L of the vibration transmitting member 30, 40 are lockable, and the clearance CL1 for allowing the inner housing 20 to move with respect to the vibration transmitting member 30, 40 is provided between the lock projections 55R, 55L and the lock pieces 51R, 51L. According to this configuration, by locking the lock pieces 51R, 51L of the inner housing 20 to the lock projections 55R, 55L of the vibration transmitting member 30, 40 without the inner housing 20 being connected to the mating housing 90, these components can be handled integrally. Further, the inner housing 20 and the vibration transmitting member 30, 40 can be handled integrally while a relative movement of the inner housing 20 is ensured since the clearance CL1 is provided between the lock projections 55R, 55L and the lock pieces 51R, 51L.

Further, the vibration transmitting member 30, 40 includes the outer housing 30 having the mating contact portion 31A and configured to cover the inner housing 20, and the cover 40 having the wire fixing portion 43 and configured to cover the outer housing 30 and the wires W. According to this configuration, the inner housing 20, the outer housing 30 and the wires W can be covered and protected from outside by the cover 40.

Further, the outer housing 30 is facing the mating housing 90 across the first clearance CL1, and facing the inner housing 20 across the second clearance CL2 larger than the first clearance CL1. According to this configuration, even if the outer housing 30 comes into contact with the mating housing 90 (i.e. moves a dimension of the first clearance CL1), the outer housing 30 does not come into contact with the inner housing 20 and vibration from the wire W is not transmitted directly to the inner housing 20 since a moving distance of the outer housing 30 is shorter than a dimension of the second clearance CL2.

The invention is not limited to the above described and illustrated embodiment. For example, the following embodiments can be employed.

The vibration transmitting member 30, 40 is constituted by the outer housing 30 and the cover 40, and the outer housing 30 is relatively movable with respect to the cover member 40 in the above embodiment. However, a cover may be fit tightly to an outer housing and the outer housing does not float with respect to the cover member. In this way, vibration from a wire can reliably escape to a mating housing. Alternatively, a cover and an outer housing may be integrated to form a vibration transmitting member. In this way, the number of components can be reduced.

Although the wire fixing portion 43 is constituted by the wire tube 43A and the rear opening 43B in the above embodiment, the configuration of the wire fixing portion 43 is not limited to this. For example, the rear opening 43B may have an inner diameter and a shape corresponding to the wires W, and the wires W may be directly tightly inserted into the rear opening 43B.

Although the cover 40 constitutes the vibration transmitting member in the above embodiment, the vibration transmitting member may be provided separately from the cover 40 and, in this case, the cover 40 may be omitted.

Although the inner housing 20 and the outer housing 30 are handled integrally using the first locks 50 in the above embodiment, no first lock may be provided and an inner housing and an outer housing may be handled as separate members. Since the inner housing can be held out of contact with the outer housing with a mating housing connected to a female housing in this way, the transmission of vibration from a wire to the inner housing can be prevented more effectively.

Although the outer housing 30 is facing the mating housing 90 across the first clearance CL1 and facing the inner housing 20 across the second clearance CL2 larger than the first clearance CL1 in the above embodiment, an outer housing may be held in close contact with a mating housing (i.e. the first clearance is zero). In this way, vibration from a wire can escape more reliably to the mating housing.

LIST OF REFERENCE SIGNS

1: female connector (connector)
20: inner housing
30: outer housing (vibration transmitting member)
31A: inner peripheral surface (mating contact portion)
40: cover (vibration transmitting member)
43: wire fixing portion
90: mating housing
CL1: first clearance
CL2: second clearance

The invention claimed is:

1. A connector, comprising:

an inner housing, a wire being pulled out to outside from the inner housing, the inner housing being connected to a mating housing; and, a vibration transmitting member including a mating contact portion capable of coming into contact with the mating housing, wherein:

the vibration transmitting member includes a wire fixing portion, the wire being fixed to the wire fixing portion, and is capable of transmitting vibration from the wire fixing portion to the mating housing from the mating contact portion, the vibration transmitting member includes an outer housing having the mating contact portion and configured to cover the inner housing and a cover member having the wire fixing portion and configured to cover most of the outer housing and the wire, the inner housing is allowed to relatively move with respect to the vibration transmitting member, the inner housing includes a lock piece, a lock projection of the vibration transmitting member being lockable to the lock piece, and a clearance for allowing the inner housing to relatively move with respect to the vibration transmitting member is provided between the lock projection and the lock piece.

2. The connector of claim 1, wherein the outer housing is facing the mating housing across a first clearance and facing the inner housing across a second clearance larger than the first clearance.

3. A connector, comprising:

an inner housing having a base with opposite front and rear ends and a cavity extending through the inner housing in a front-rear direction from the front end to the rear end, a rear receptacle connected to the rear end of the base and projecting forward so that a forwardly open fitting space is defined between the base and the rear receptacle;

a terminal connected to a wire, the terminal being inserted in the cavity of the inner housing so that the wire extends rearward from the inner housing;

an outer housing fit in the fitting space and having a mating contact surface facing inwardly toward the base of the inner housing;

a cover fit over the inner housing and the outer housing, the cover having a wire fixing portion fixed to a part of the wire rearward of the inner housing; and a mating housing fittable into the fitting space inward of the outer housing and outward of the base of the inner housing, a mating terminal disposed in the mating housing and being connectable to the terminal, wherein the mating contact surface of the outer housing faces an outer surface of the mating housing across a first clearance in a direction transverse to the front rear direction, and an outer surface of the outer housing faces an inner surface of the rear receptacle of the inner housing across a second clearance in the direction transverse to the front rear direction, the second clearance being larger than the first clearance.

4. The connector of claim 3 wherein the cover is engageable with the outer housing but is spaced outward from the inner housing.

5. The connector of claim 3 further comprising a sealing ring mounted over the base of the inner housing and engaged with an inner surface of the mating housing.

* * * * *